United States Patent [19]

Acoraci

[11] 4,356,461

[45] Oct. 26, 1982

[54] PRACTICAL IMPLEMENTATION OF LARGE BUTLER MATRICES

[75] Inventor: Joseph H. Acoraci, Phoenix, Md.

[73] Assignee: The Bendix Corporation, Southfield, Mich.

[21] Appl. No.: 225,071

[22] Filed: Jan. 14, 1981

[51] Int. Cl.[3] ..... H01P 5/18

[52] U.S. Cl. ..... 333/116; 333/120; 333/161; 343/854

[58] Field of Search ..... 333/109, 116, 117, 120, 333/136; 343/854; 361/393, 395, 412, 414, 416

[56] References Cited

U.S. PATENT DOCUMENTS 3,345,585 10/1967 Hildebrand ..... 333/116
3,731,217 5/1973 Gerst et al. ..... 333/117 X
3,736,592 5/1973 Coleman ..... 343/854
4,093,928 6/1978 Proctor ..... 333/120

FOREIGN PATENT DOCUMENTS 606581 10/1960 Canada ..... 361/416

*Primary Examiner*—Paul L. Gensler
*Attorney, Agent, or Firm*—W. G. Christoforo; Bruce L. Lamb

[57] ABSTRACT

A large N×N Butler matrix is comprised of a first plurality of smaller essentially flat M×M Butler matrices arranged in a first stack and a second plurality of smaller, essentially flat P×P Butler matrices arranged in a second stack in which the planes of the matrices are orthogonal to the planes of the matrices of the first plurality. M can be equal to or differ from P.

8 Claims, 13 Drawing Figures

PRACTICAL IMPLEMENTATION OF LARGE BUTLER MATRICES

BACKGROUND OF THE INVENTION

This invention relates to large antenna beam forming networks and particularly to the type of beam forming network normally termed a Butler matrix.

A Butler matrix is a type of beam forming network which has found wide application in the microwave arts. Briefly, a Butler matrix is a 2 N port network, where $N=2^p$ and p is an interger. All ports are matched, with the N ports on the input side being mutually isolated, as are the N ports on the output side. The power transfer coefficient between any port on one side and any port on the other side is 1/N. In other words, if power is fed into any port on one side it is split uniformly among the N ports on the other side, without loss. For each port on one side used to receive input power, there will be a particular phase distribution among the ports on the other side. Generally, all of the phase distributions are linear, that is, if the ports on the output side are numbered $J=0,1,2 \ldots N-1$, the phase difference between ports n and $n-1$ is constant for all n. This constant is different for each input port. If the ports on the input side are numbered $K=0,1,2 \ldots N-1$, the transfer phase, $\phi_{KJ}$, from an input port K to an output port J can be expressed as $$\phi_{KJ}=\phi_K+J\,(\phi_o+2\pi K/N)$$

where $\phi_o$ and $\phi_K$ are arbitrary constants known to those skilled in the art and generally determined by the network application. For example, matrix fed circular arrays require cyclic output phase distribution for which $\phi_o=0$.

In a practical sense, Butler matrices are usually built up of hybrid direction couplers, normally 3 dB couplers, and phase shift elements. The Butler matrices of the prior art are planar structures wherein the hybrids and phase shifters are made according to strip line techniques and arranged side-by-side. Following the rules for the design of Butler matrices, which rules are readily available in the literature of the art, matrices of practically any size are theoretically possible. However, again in a practical sense, large Butler matrices, in the sense of a large number of ports, have not been used because the physical size has made such matrices cumbersome and the internal interconnections of a large matrix have been unwieldy. For example, a 64-element circular array fed by a 64×64 Butler matrix would have an antenna aperture essentially equal to the diameter of the array. However, due to the aforementioned disadvantages of a large Butler matrix, such as a 64×64 matrix, a 64-element circular array recently built did not use a Butler matrix but rather used a commutator or transfer switch matrix of the prior art type which could excite only about 16 adjacent antenna elements, or one-quarter of the total antenna elements, at a time. In this case, of course, since the antenna aperture is the chord of the excited antenna elements, the size of the circular array had to be larger than if a Butler matrix had been used, to have the same antenna aperture. Specifically, the commutator fed circular array must be about 1.4 times larger in diameter than a Butler matrix fed circular array to have the same antenna aperture. Thus, it should be clear, that a practical, large Butler matrix would, in this case, permit compaction of the circular antenna array without degrading its characteristics and performance.

SUMMARY OF THE INVENTION

I have discovered a simple and convenient implementation of large Butler matrices. Using an easily constructed and readily available small Butler matrix as a basic building block, I have found that a plurality of such small matrices can be stacked physically in parallel arrangement with one another at the input end and a similar stack placed at the output end turned 90° or orthogonally with respect to the input end stack. Now, if a suitable set of fixed phase shifters or line stretchers, whose values can be calculated from known relationships, is interposed between the two stacks, a uniform set of cables can be used as interconnections. The result is an easily implemented and compact large Butler matrix.

The advantage of the invention is that it makes large Butler matrices practical as well as theoretically possible.

DESCRIPTION OF THE PREFERRED EMBODIMENT

Figure 1:
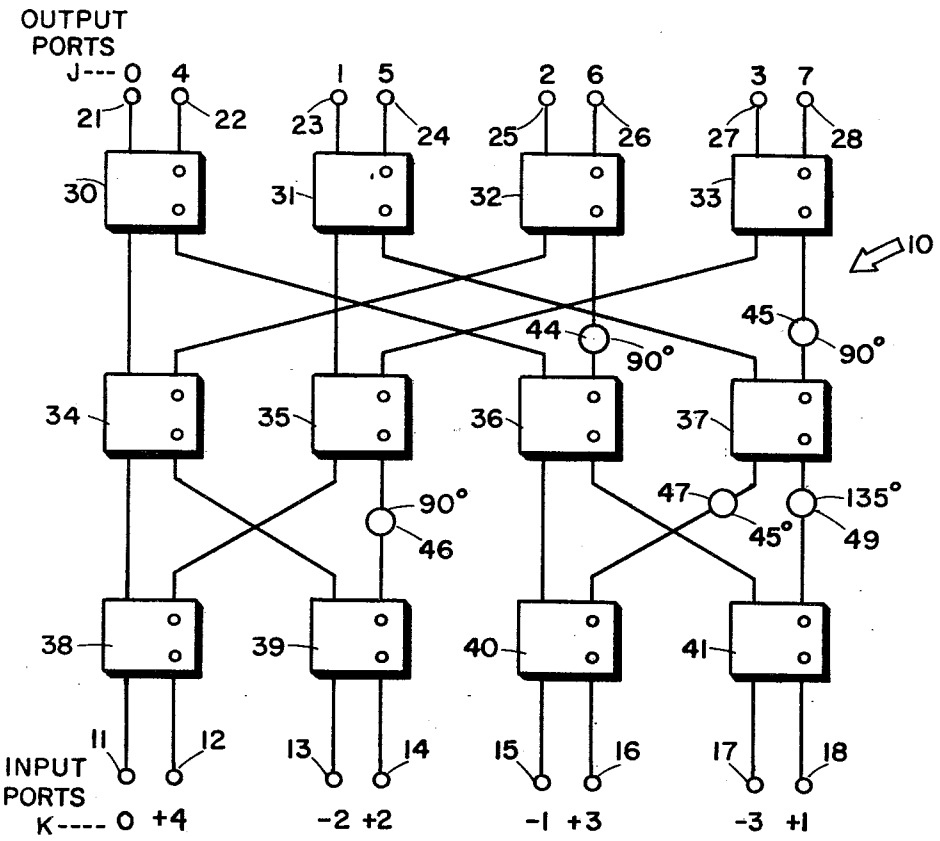
FIG. 1 is a block diagram of an 8×8 Butler matrix, which is the basic building block of a large Butler matrix made in accordance with the present invention.

Referring first to FIG. 1, an 8×8 Butler matrix 10 which comprises the basic building block of an embodiment of the present invention has eight input ports (K) designated 11 through 18 and having the K designations 0, +4, −2, +2, −1, +3, −3 and +1, respectively. There are eight output ports (J) designated 21 through 28 and having the J designations 0, 4, 1, 5, 2, 6, 3 and 7, respectively. This Butler matrix is comprised of twelve 180° hybrids 30 through 41, three 90° fixed phase shifters 44, 45 and 46, a 45° fixed phase shifter 47 and a 135° fixed phase shifter 49.

Figure 2:
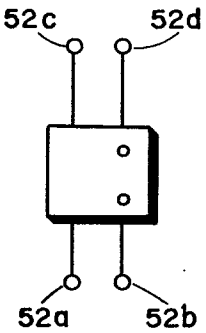
FIG. 2 is a block diagram of a 3 dB hybrid used in the matrix of FIG. 1 and is useful to show the conventions used in these figures.

The hybrid convention is illustrated at FIG. 2, reference to which should now be made. A typical hybrid of the type used in the 8×8 matrix of FIG. 1 has an undotted input port 52*a*, a dotted input port 52*b*, an undotted output port 52*c* and a dotted output port 52*d*. A signal at undotted input port 52*a* is split into two equal amplitude, in-phase signals, at output ports 52*c* and 52*d*, respectively. A signal at dotted port 52*b* is split into two equal amplitude signals at the output ports, where the signal at dotted output port 52*d* is phase shifted 180° with respect to the input signal and the signal at the undotted output port 52*c*.

Returning to FIG. 1, Butler matrices generally and the Butler matrix of FIG. 1 and their operation are well known to those skilled in the art. Briefly, Butler matrices are generally passive and reciprocal microwave devices. With respect to the 8×8 matrix illustrated, a signal into any K input port results in signals of equal amplitude and a linear phase gradient at the J output ports. The phase gradient is determined by which input port is excited. For example, it can be seen that if input port 11 (K port 0) is energized the resulting signals at the output ports are in-phase. If input port 14 (K port +2) is energized the phase gradient across the J output ports (J ports 0, 1, . . . 7) is +90°, while if input port 13 (K port −2) is energized the phase gradient across the J output ports is −90°. Thus, the phase gradient mathematical relationship presented above is satisfied, using the K and J port numbers, and assuming $\theta_k$ and $\theta_o$ are zero, a valid assumption as will be explained below.

Figure 3A:
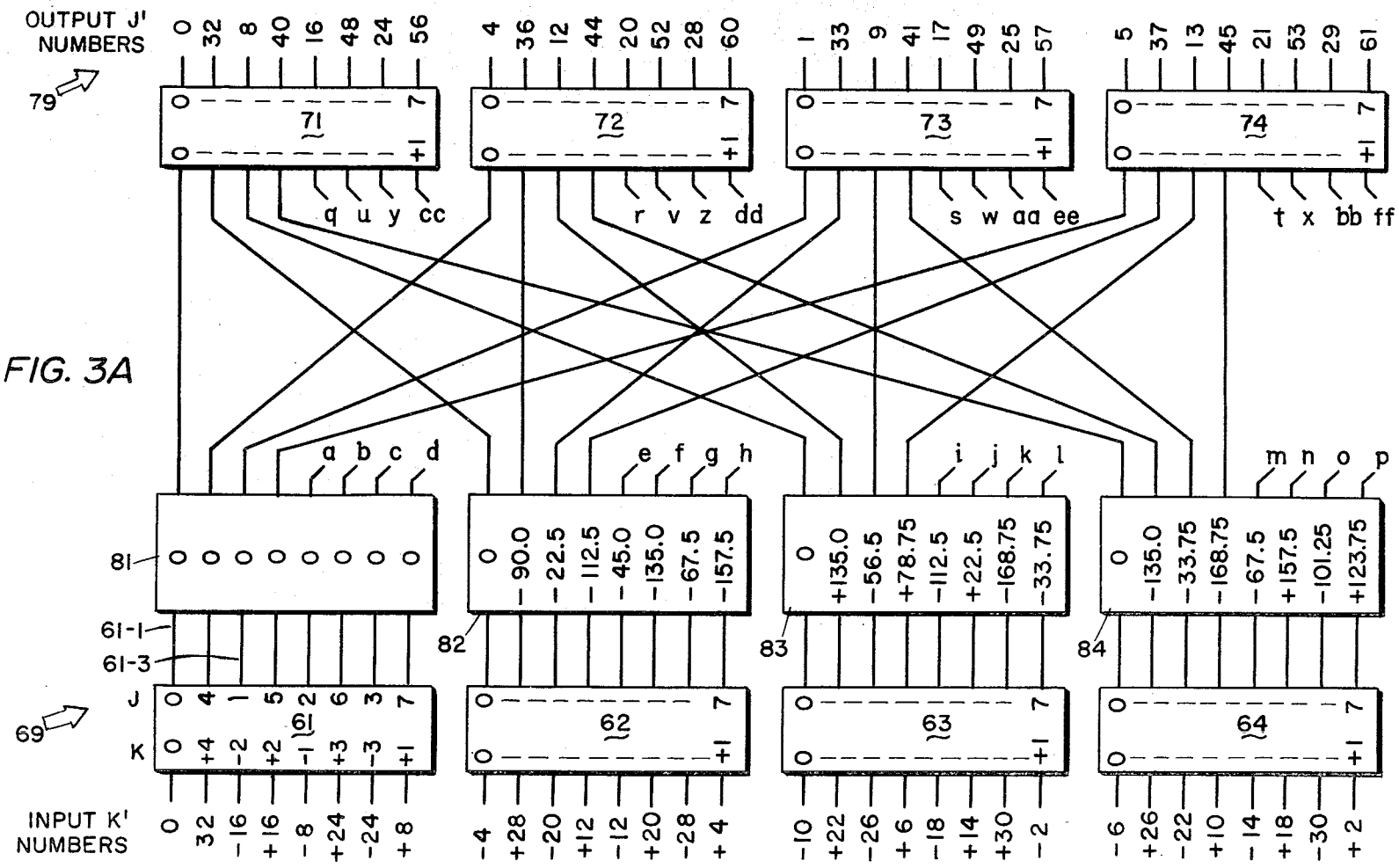
FIGS. 3A and 3B taken together comprise a block schematic diagram of one embodiment of the invention.
Figure 3B:
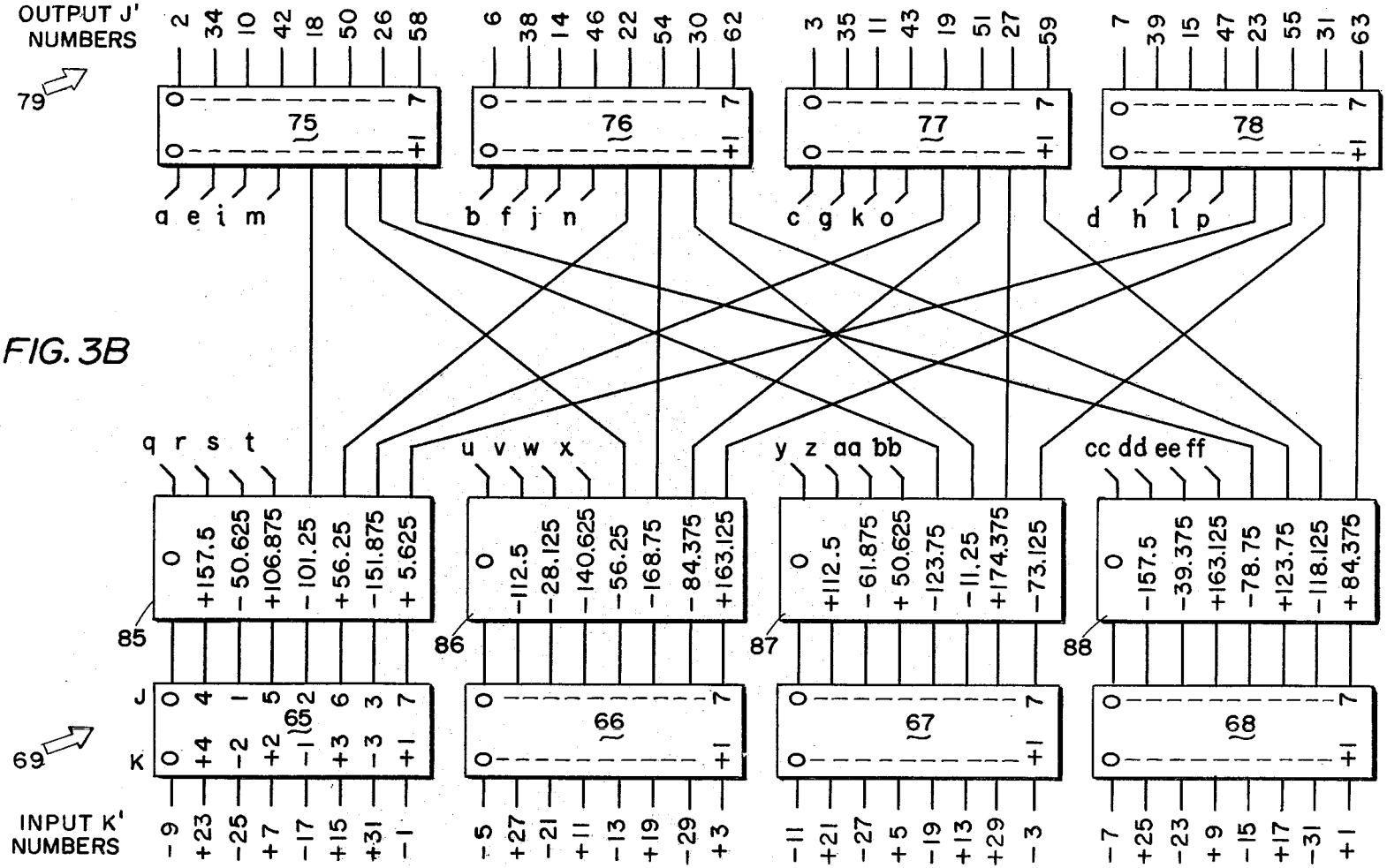

Refer now to FIGS. 3A and 3B which are to be considered together and which thus comprise a block schematic diagram of the preferred embodiment of the invention as a 64×64 Butler matrix. More particularly, any line to FIG. 3A terminating in a letter (a, b, etc.) is to be considered connected to and the same line of FIG. 3B which terminates in the same letter. Thus, the line of FIG. 3A which terminates in the letter "a" is the same line as that of FIG. 3B which terminates in the letter "a". FIG. 3A and 3B show a 64×64 Butler matrix comprised of eight 8×8 Butler matrices 61–68 at one end 69, here shown as the input end, and further comprised of eight additional 8×8 Butler matrices 71–78 at the other end 79, here shown as the output end. In this embodiment each 8×8 Butler matrix is identical to the matrix of FIG. 1. It should be further understood that each 8×8 matrix is disposed in FIGS. 3A and 3B exactly as shown in FIG. 1, that is, with the K input port numbers reading from left to right being 0, +4, −2, +2, −1, +3, −3 and +1 and the J output ports reading from left to right being 0, 4, 1, 5, 2, 6, 3 and 7 and as labeled in block 61, for example. The J output ports of the input end 8×8 Butler matrices 61–68 are connected through suitable microwave cables and line stretchers 81–88 to the K input ports of the output end 8×8 Butler matrices 71–78 in the standard Butler matrix schematic configuration. Specifically, line stretchers 81–88 are included in the connecting cables from matrices 61–68. For simplicity, only two connecting cables, 61-1 and 61-3, are specifically labeled.

The input ports of the 64×64 matrix have the cyclical set of K′ numbers from 0 to 32 through both the positive and negative integers as indicated on FIGS. 3A and 3B. (The input and output ports of a Butler matrix are conventionally termed the K and J ports, respectively. In keeping with that convention the respective ports of an 8×8 matrix are herein designated K and J ports and the ports of the 64×64 matrix are designated K′ and J′ ports. In the mathematical expressions presented herein K and J are used. However, it should be understood that K′ and J′ should be substituted respectfully therefor when considering the 64×64 matrix.) This set, of course, includes 64 distinct and different numbers. It can thus be seen that each K′ input port is designated by a different number. The output ports are designated by the J′ set of numbers from 0–63. The significance of the K′ and J′ sets of numbers is known to those skilled in the art and is reviewed immediately below.

Remembering the mathematical expression first presented above:

$$\phi_{KJ}=\phi_K+J\,(\phi_o+2\pi\ K/N)$$

$\phi_o$ is equal to zero in the present embodiment as it is intended for use in the feed network for a circular antenna array. The constant $\phi_K$ can be disregarded for the present calculations, thus, the relationship becomes:

$$\phi_{KJ}=2\pi\ JK/N$$

where

N=8, 64 for an 8×8 and 64×64 matrix respectively or $\phi_{KJ}$=45 KJ for an 8×8 matrix and $\phi_{KJ}$=5.625 KJ for a 64×64 matrix.

Assuming the phase of the signal exciting the K input port is taken as zero phase the above expression becomes:

$$\phi_J=2\ KJ/N$$

or, in other words, the phase of the signal at the $J^{th}$ output port is equal to $2\pi/N$ times the product of the J and K numbers. It will be noted from the above relationship that the phase gradient of the signals at the output ports of a Butler matrix will shift in equal steps through 360° as the K input ports are individually and consecutively excited.

The factor $2\pi K/N$ is defined as the phase gradient $\delta$ which is the phase difference between the signals at J output ports n and n+1. It should be clear that:

$$\phi_J=\delta J$$

since the J output terminal 0 is the reference phase port.

One using the above mathematical expressions for the 64×64 Butler matrix of FIG. 3 will find the phase angles of the signals at the J′ output ports will be offset by a fixed angle for many of K′ input ports individually excited. These fixed phase angles are compensated by the line stretcher means 81–88, respectively, connected into the cables from 8×8 matrices 61–68. In this embodiment each line stretcher means consists of 8 individual line stretchers, one for each associated 8×8 matrix J output port. The electrical angle rotation provided by each line stretcher is as clearly listed in FIGS. 3A and 3B.

One can easily verify the validity of the above mathematical expressions and line stretcher values by simply tracing a signal from a K′ input port to a J′ output port. For example, consider exciting the K′ input port +4 and the resulting phase at J′ output ports 0 and 1. First, tracing the signal from the K′ input port +4 of the 64×64 matrix to the K input port +1 of the 8×8 matrix 62 and thence to the J output ports 0 and 1 thereof. The J output port 0 of matrix 62 is connected through a zero phase shift line stretcher to the K input port +4 of matrix 71 and then to its J output port 0 which is also the J' output port 0 of the 64×64 matrix.

According to the expression:

$$\theta_{KJ}=2\pi\ JK/N,$$

where for the 64×64 matrix K'=+4 and J'=0

$$\theta_{KJ}=0.$$

Taking each element individually, the phase shift through matrices 62 and 71 is zero and there is no phase shift introduced by line stretcher means 82, thus the mathematical relationship is verified.

As for the signal at J' output port 1, the K' input port +4 is also the K input port +1 of matrix 62. The J output port 1 of matrix 62 is connected through a −22.5° line stretcher to the K input port +4 of matrix 73. The J' output port 1 corresponds to the J output port 0 of matrix 73. The overall phase shift through the 64×64 matrix is according to the expression:

$$\theta_{KJ}=2\pi\ JK/N,$$

where

K'=+4 and J'=1

$$\theta_{KJ}=22.5°.$$

Taking each element individually, the phase shift through matrix 62 is, where K=1 and J=1

$$\theta_{KJ}=45 \text{ for matrix } 62.$$

The phase shift, $\theta$, introduced by the line stretcher is:

$$\theta=-22.5°.$$

The phase shift through matrix 73 is, where its K=+4 and J=0:

$$\theta_{KJ}=0 \text{ for matrix } 73.$$

The total phase shift from K' input port +4 to J' output port 1 considering the individual elements, is the sum of the phase shifts through the individual elements or 22.5°, which is the same as the phase shift calculated across the 64×64 matrix as a whole.

From the above example one can now easily verify the validity of the 64×64 matrix of FIGS. 3A and 3B.

Figure 4:
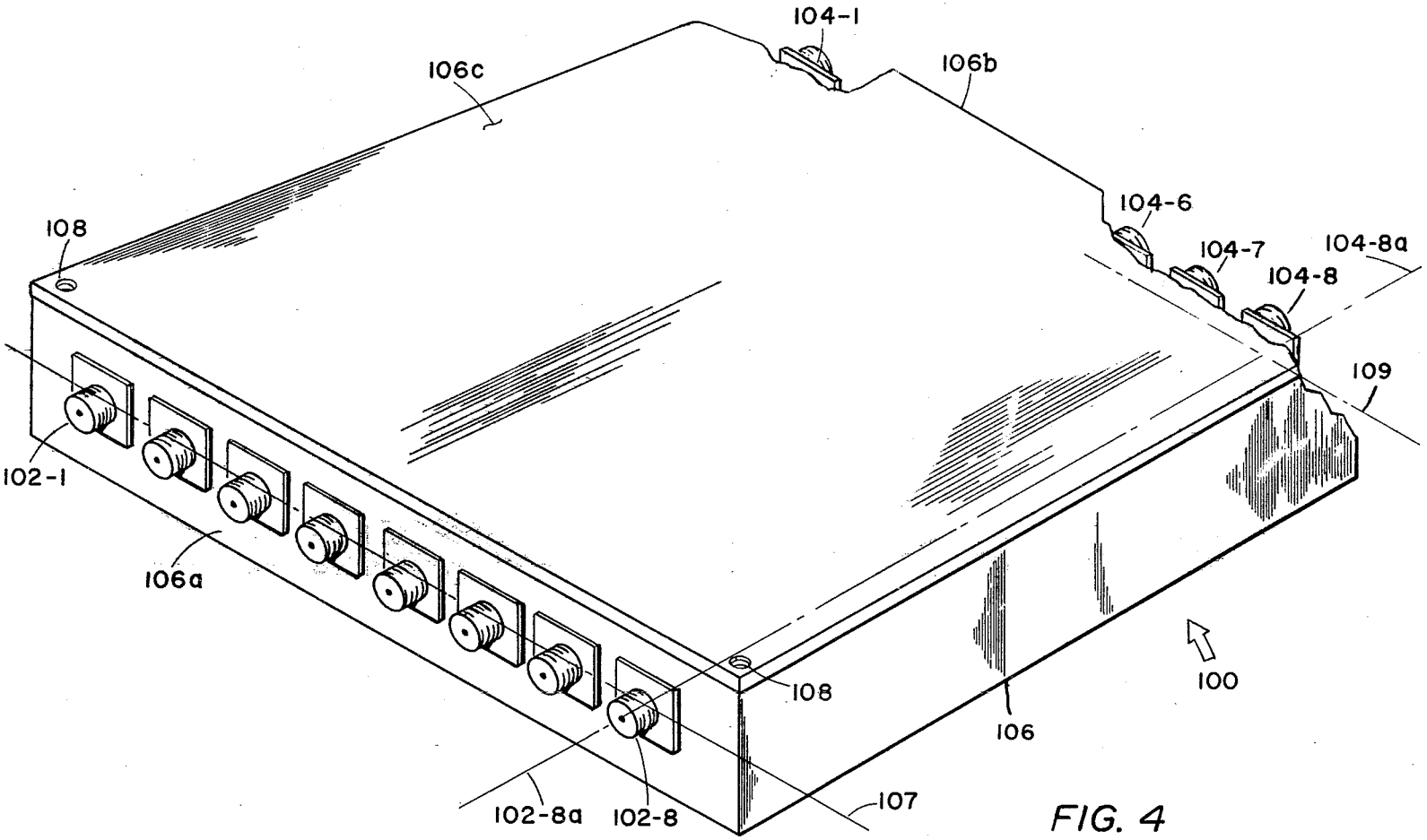
FIG. 4 shows a practical embodiment of an 8×8 Butler matrix which is the main building block of the invention embodiment of FIG. 11.

Refer now to FIG. 4 which is an isometric view of an actual 8×8 matrix 100 used in an embodiment of the present invention. Matrix 100 is housed in a standard microwave shielded square box 106 of about 9×9 inches and 0.75 inches high. Eight SMA type microwave connectors, for example, 102-1 to 102-8 are arranged on one side 106*a* of box 106 and comprise the K input ports. The J output ports comprise 8 further SMA type connectors, for example, 104-1 to 104-8, disposed on the opposite side 106*b*. A line 107 drawn through connectors 102-1 and 102-8 is termed the longitudinal axis of side 106*a*. Similarly, a line 109 drawn through the centers of connectors 104-1 to 104-8 is termed the longitudinal axis of side 106*b*. It can be seen that the longitudinal axes of opposing connectors 102-8 and 104-8 have longitudinal axes 102-8*a* and 104-8*a*, respectively, which coincide with one another to comprise a single longitudinal axis of connectors 102-8 and 104-8. A cover 106*c* is held in place by screws 108.

Figure 7:
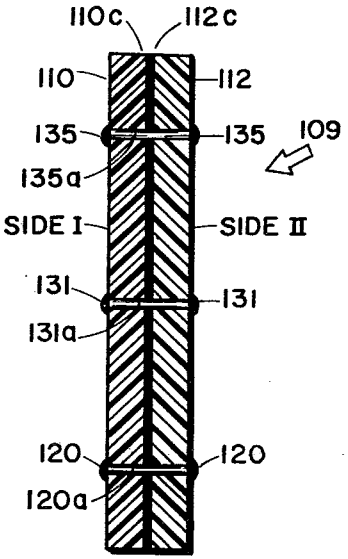
FIG. 7 shows how the circuit boards of FIGS. 5 and 6 are connected.
Figure 6:
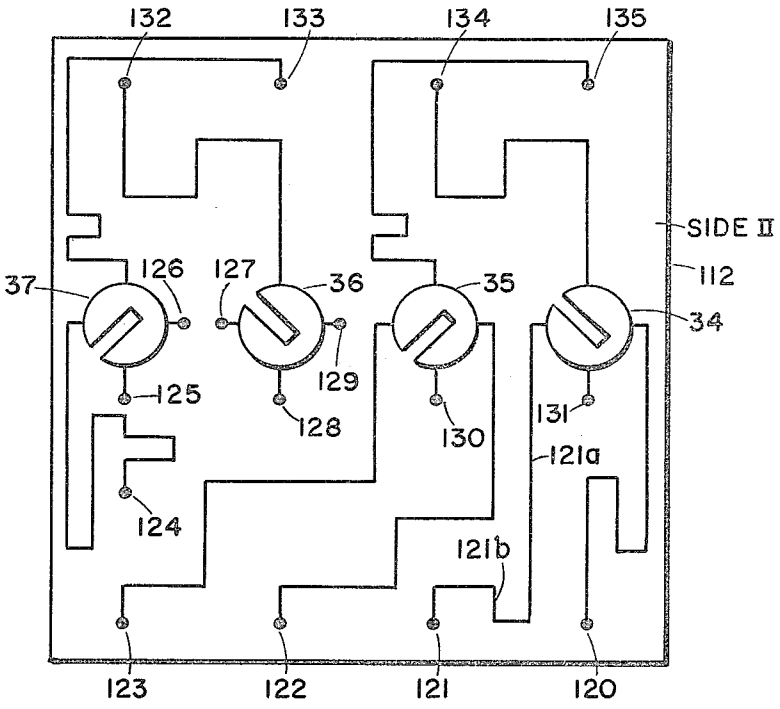
FIG. 6 schematically illustrates the additional circuitry for the Butler matrix of FIG. 4 on a second microstrip circuit board.
Figure 5:
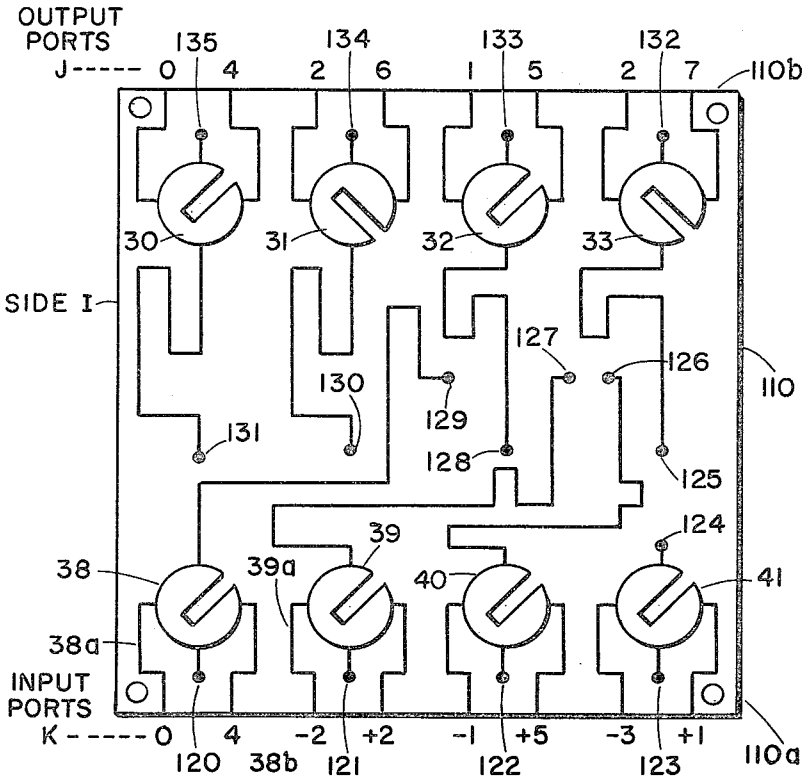
FIG. 5 schematically illustrates one side of a microstrip circuit board used in the 8×8 Butler matrix of FIG. 4.

Refer now to FIGS. 5 and 6 which together show the actual 8×8 Butler matrix used with the present embodiment of the invention wherein the matrix is disposed on microstrip circuit boards, FIG. 5 being side I of a printed circuit board means and FIG. 6 being side II of the same means. More particularly, side I is disposed on a first board 110 and side II is disposed on a second board 112. Each board 110 and 112 has a microstrip ground plane disposed on its side which is unseen in these figures. As will be explained more fully with respect to FIG. 7, boards 110 and 112 are assembled ground plane to ground plane, so that those points in the various FIGS. 5 and 6 having identical legends overlie one another, to form the above mentioned printed circuit board means. Although the conductive tracks seen in FIGS. 5 and 6 are shown in the correct relative locations in accordance with a real embodiment of the invention, the tracks are shown schematically as lines of negligible width, for clarity, rather than as tracks as in the actual embodiment. It should thus be understood that the lines of FIGS. 5 and 6 are, in the real embodiment, microstrip tracks as shown, in greater detail, in FIGS. 8 and 9. The boards are generally of the same size to nestle, back to back, into the interior. The numerals used to distinguish the elements of FIGS. 5 and 6 are identical to numerals used for like elements of FIG. 1 and will aid one in seeing the relationships between these various figures. K input ports 0, 4, −2, +2, −1, +3, −3 and +1 are disposed, respectively, across one edge 110*a* of board 110,while the J output ports 0, 4, 2, 6, 1, 5, 3 and 7 are disposed, respectively, across the opposite edge 110*b*. Eight hybrids 38–41 and 30–33 are disposed on side I, while hybrids 34–37 are disposed on side II. The points 120–135 seen both in FIGS. 5 and 6 are common electrical points which overlie one another when the boards are placed ground plane to ground plane and electrical connections made through the points. This is shown in FIG. 7 where a side view of boards 110 and 112 is seen, with their ground planes 110*c* and 112*c* in intimate electrical contact with one another and the common points 120, 131 and 135, for example, electrically connected by bus wires 120*a*, 131*a* and 135*a*, respectively, inserted between the same points on sides I and II through the boards. It should be understood that the various bus wires extending through the boards, for example, bus wires 120*a*, 131*a* and 135*a*, are electrically fastened by soldering or welding to the appropriate points on sides I and II and thus aid to hold boards 110 and 112 together and in alignment in the conventional manner.

Figure 8:
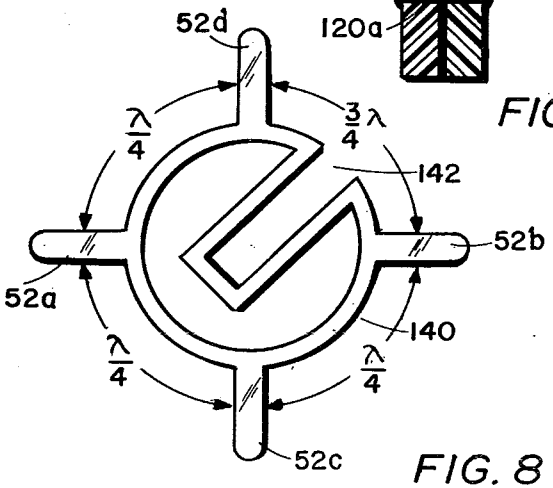
FIG. 8 shows an enlarged view of one hybrid of FIGS. 5 and 6 and is useful in explaining the conventions used.

Refer now to FIG. 8 which shows in greater detail one of the 180° hybrids of FIGS. 5 and 6. FIG. 8 is simply the embodiment of the schematic of FIG. 2, which one should also refer to at this time as like terminals in these figures are numbered identically. This typical 180° hybrid is what is known in the art as a 1.5 wavelength rat-race hybrid, which in this embodiment is made in accordance with standard microstrip techniques. The hybrid consists of a generally annular track 140 having the indentation 142 between terminals 52*b* and 52*d*. Four terminals 52*a*, 52*b*, 52*c* and 52*d* are equally spaced, radially extending from track 140. With reference to FIG. 2 it can be seen that terminals 52*a* and 52*b* are the input terminals and terminals 52*c* and 52*d* are output terminals, terminals 52b and 52d being the dotted terminals. The phase shift between terminals 52b and 52d is $\frac{3}{4}$ wavelength, while the phase shifts between other adjacent terminals is $\frac{1}{4}$ wavelength as known to those in the art.

Returning to FIGS. 1, 5 and 6, phase shifters 44–49 of FIG. 1 are not seen in detail in FIGS. 5 and 6 since the phase shifts are, in the real embodiment, provided by the electrical tracks on the circuit boards connecting the various hybrids and are thus distributed and not specifically identifiable, as known to those skilled in the art. For example, microstrip track 121a of FIG. 6 connecting terminal 121 to hybrid 34 includes sinuous portion 121b which, together with the track as a whole, provides the −45° phase shift of shifter 47 (FIG. 1).

Figures 9, 10:
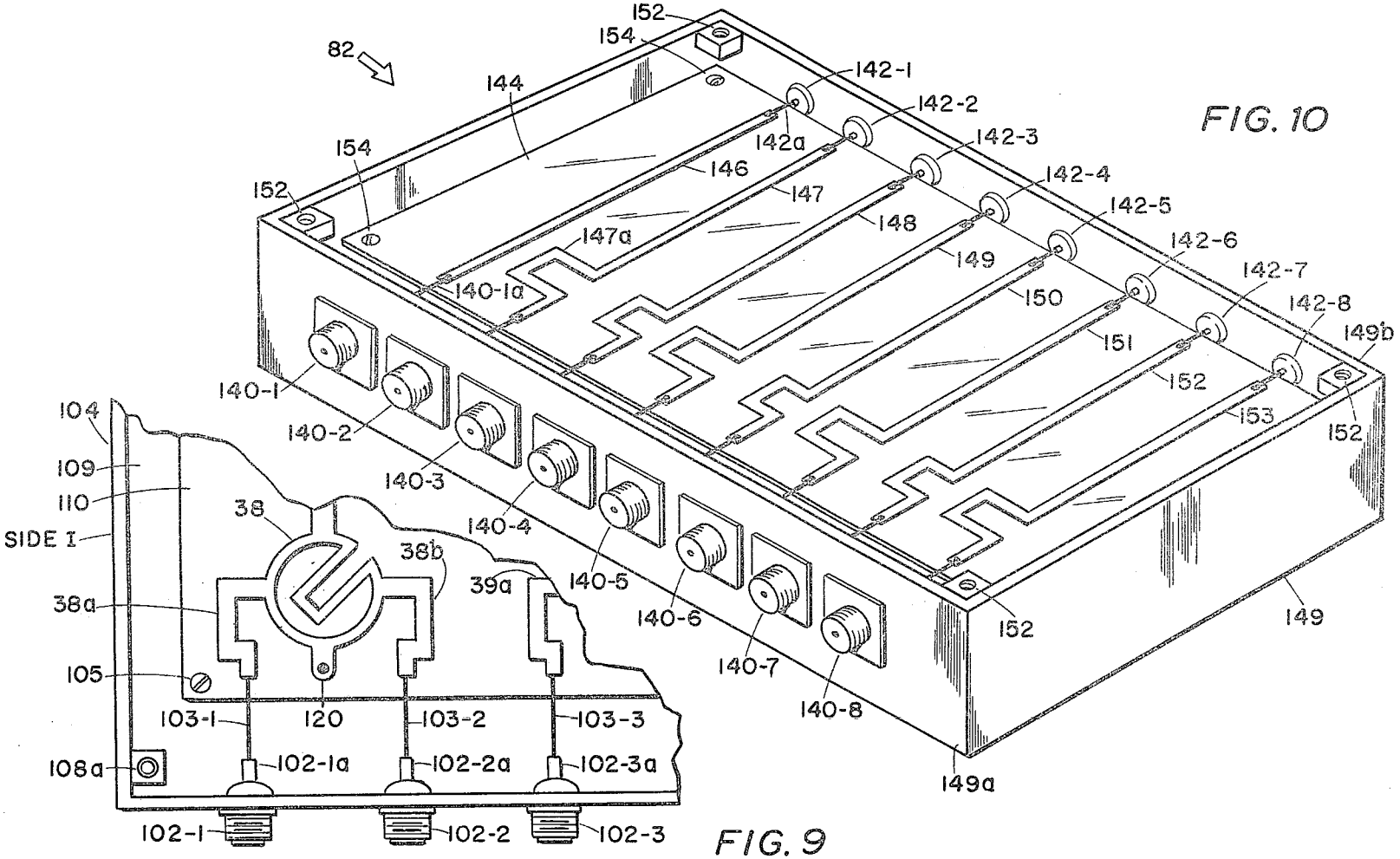
FIG. 9 is a partial view of the interior construction of the 8×8 Butler matrix of FIG. 4.
FIG. 10 illustrates the construction of a line stretcher means used in the preferred embodiment of the invention.

Refer now to FIG. 9 which shows a portion of the 8×8 matrix of FIG. 4 with its cover (item 106c of FIG. 4) removed to show the left corner of side I of printed circuit board 110, and more particularly, that part of the board carrying hybrid 38 and microstrip tracks 38a, 38b and 39a, seen here and also in FIG. 5. Shown also is a conventional threaded block 108a which receives a cover screw 108 of FIG. 4. Three coaxial microwave connectors 102-1, 102-2 and 102-3 are seen, mounted to a wall of case 104, having center conductors 102-1a, 102-2a, and 102-3a, respectively, electrically connected to tracks 38a, 38b and 39a on board 110 through bus wires 103-1, 103-2 and 103-3. It should be understood that board 110 is the top board of the board assembly 109 comprised also of board 112 (not seen in the figure). Board assembly 109 is mounted on standoffs (not shown) and held in place within box 104 by screws 105, for example.

Refer now to FIG. 10 which illustrates a practical line stretcher means 82 such as that whose schematic is seen as item 82 of FIG. 3A. Line stretcher means 82 is comprised of a box 149, whose cover is here seen removed to show internal details. In use a cover is fastened in place by conventional means at tapped blocks 152 mounted at the interior corners of box 149. With a cover in place box 149 is sealed to microwave frequencies. A printed circuit board 144, mounted on standoffs (not shown) through screws 154 includes eight line stretchers 146–153 in the form of microstrips disposed on the surface of board 144. Eight coaxial connectors 140-1 to 140-8 are mounted on one side 149a of box 149 and eight additional coaxial connectors 142-1 to 142-8 are mounted on the opposite side 149b. These connectors comprise the input and output connections, respectively, to the line stretcher means. The center conductors of the connectors are electrically connected, respectively, in pairs to the line stretchers. For example, center conductors 140-1a and 142-1a are electrically connected, suitably by soldering, respectively, to the extreme ends of line stretcher 146.

The line stretchers are conventional, being simply microstrip tracks whose reference is just a straight section, for example, the line stretcher 146 which is here the reference, and stretchers having a sinuous conductive path to provide a phase shift, such as line stretcher 147 having a sinuous section 147a. Thus, for example, line stretcher 147 provides a 90° phase delay to signals traversing therethrough with respect to signals passing through line stretcher 146.

Referring again briefly to FIGS. 3A and 3B, it can be seen that certain line stretcher phase shifts are positive. For example, line stretcher means 83 calls for phase shifts of +135, +78.75 and +22.5 degrees in addition to various phase delays. These positive phase shifts are, of course, equivalent to phase delays, where the equivalent phase delay is equal to the positive phase shift less 360 degrees. Thus, a phase shift of +135 degrees can be embodied by a line stretcher which introduces a 225 degree phase delay. Thus, line stretcher means such as illustrated in FIG. 10 can be used for both positive and negative phase shifts.

Figure 11:
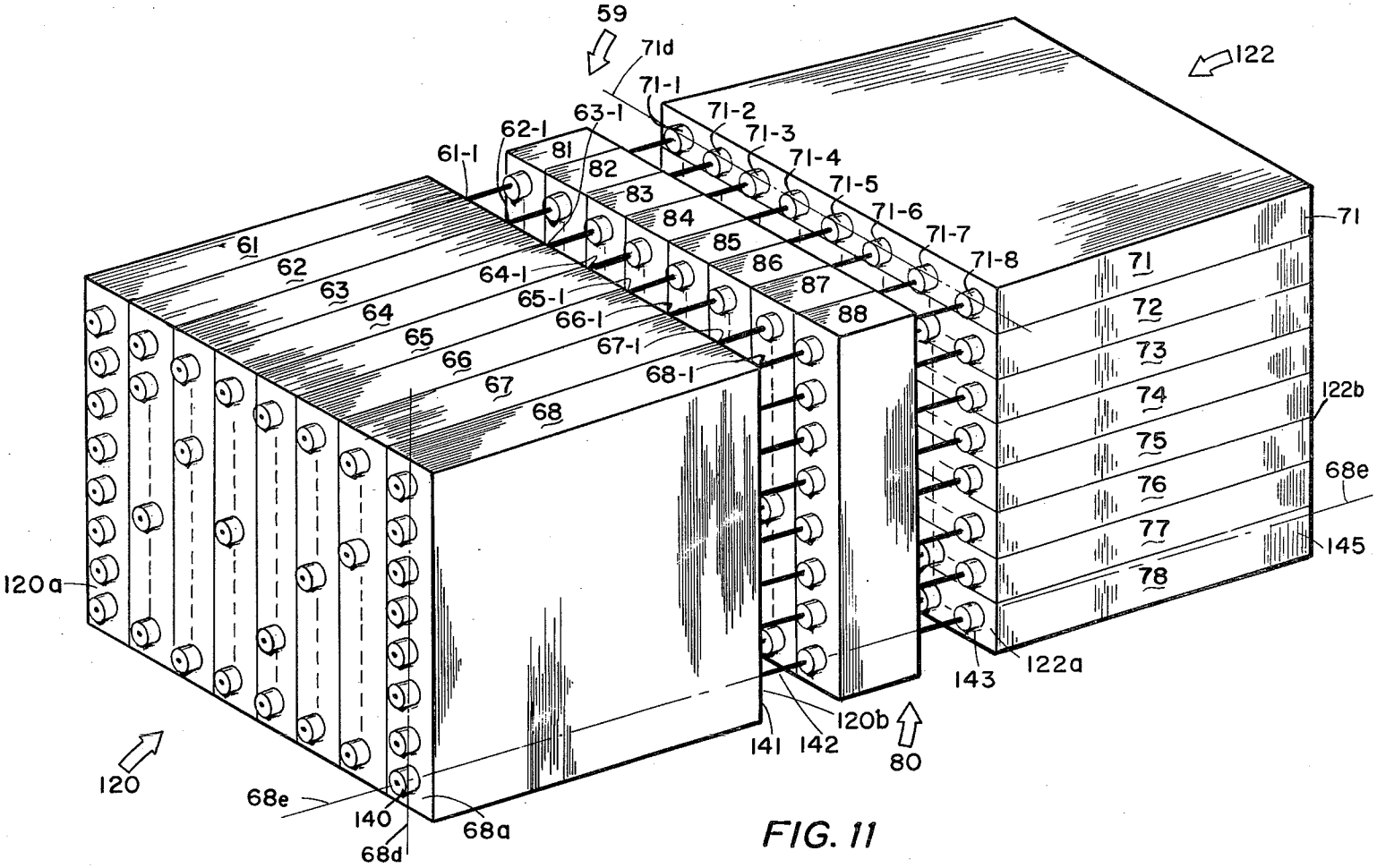
FIG. 11 illustrates a 64×64 Butler matrix made in accordance with the principles of this invention.

Refer now to FIG. 11 which illustrates the gravamen of the present invention. Here the eight 8×8 Butler matrices 61 to 68 are arranged vertically in an input side stack 120 and the eight Butler matrices 71 to 78 are arranged horizontally in an output side stack 122 to comprise the 64×64 Butler matrix 59. There are thus 64 ports 140 on stack face 120a which comprise not only the input ports of stack 120, but also of the 64×64 Butler matrix 59. The longitudinal axes through ports 140, for example, axis 68e, generally coincide with the longitudinal axes through associated stack output ports 141. There are, of course, 64 stack 120 output ports 141 on stack face 120b, which is the face opposite face 120a and which is not seen in this figure. In like manner, stack 122 includes an input face 122a and an output face 122b (not seen). There are 64 stack input connectors 143 to stack 122 arranged on face 122a and 64 stack output connectors 145 arranged on face 122b.

As stated above, the 8×8 Butler matrices of stack 120 are arranged to be orthogonal to the 8×8 Butler matrices of stack 122. For example, longitudinal axis 68d of side 68a of a typical 8×8 Butler matrix 68 included in input stack 120 is orthogonal to the longitudinal axis 71d of the input connector side of typical 8×8 Butler matrix 71 included in output stack 122 where, as explained above, the longitudinal axis of a side is a line through the connectors of that side of an 8×8 matrix. A longitudinal axis, such as line 68e, which is the longitudinal axis of an input connector 140, generally coincides with associated connectors of the phase shifters and Butler matrices of the output stack. Here, typical longitudinal axis 68e coincides with longitudinal axes of the bottom connectors (in this view) of 8×8 Butler matrix 68 and line stretcher means 88 and the right end connectors of 8×8 Butler matrix 78. It can now be seen that the output ports of stack 120 are aligned exactly with the appropriate input ports of stack 122. For example, output ports 61-1 to 68-1 (not seen) of stack 120 are lined up respectively with input ports 71-1 to 71-8 of stack 122. With reference to FIGS. 3A and 3B, it can be seen that the appropriate ports are aligned. It is now merely necessary to insert eight line stretcher means 80, a typical one being illustrated at FIG. 10, into the system of FIG. 11 to provide the phase shifts called for by FIGS. 3A and 3B. These line stretcher means are conveniently packaged in eight units 81–88 of eight phase shifters each, as should now be obvious, and inserted directly into the 64×64 matrix as shown, intermediate between the input stack 120 and the output stack 122. In the preferred embodiment the sixteen 8×8 Butler matrices 61–68 and 71–78 as well as the eight line stretcher means 81–88 are each fitted with eight input and eight output port SMA type connectors. The line stretcher means 81–88 are preferably spaced between stacks 120 and 122 so that the interconnecting cables, one of which is numbered 142, for example, and of which there are a total of 128, are preferably all of the same length. The cables are made of semi-rigid coaxial cable in the preferred embodiment. For clarity, only representative ones of the connecting cables are shown.

Figure 12:
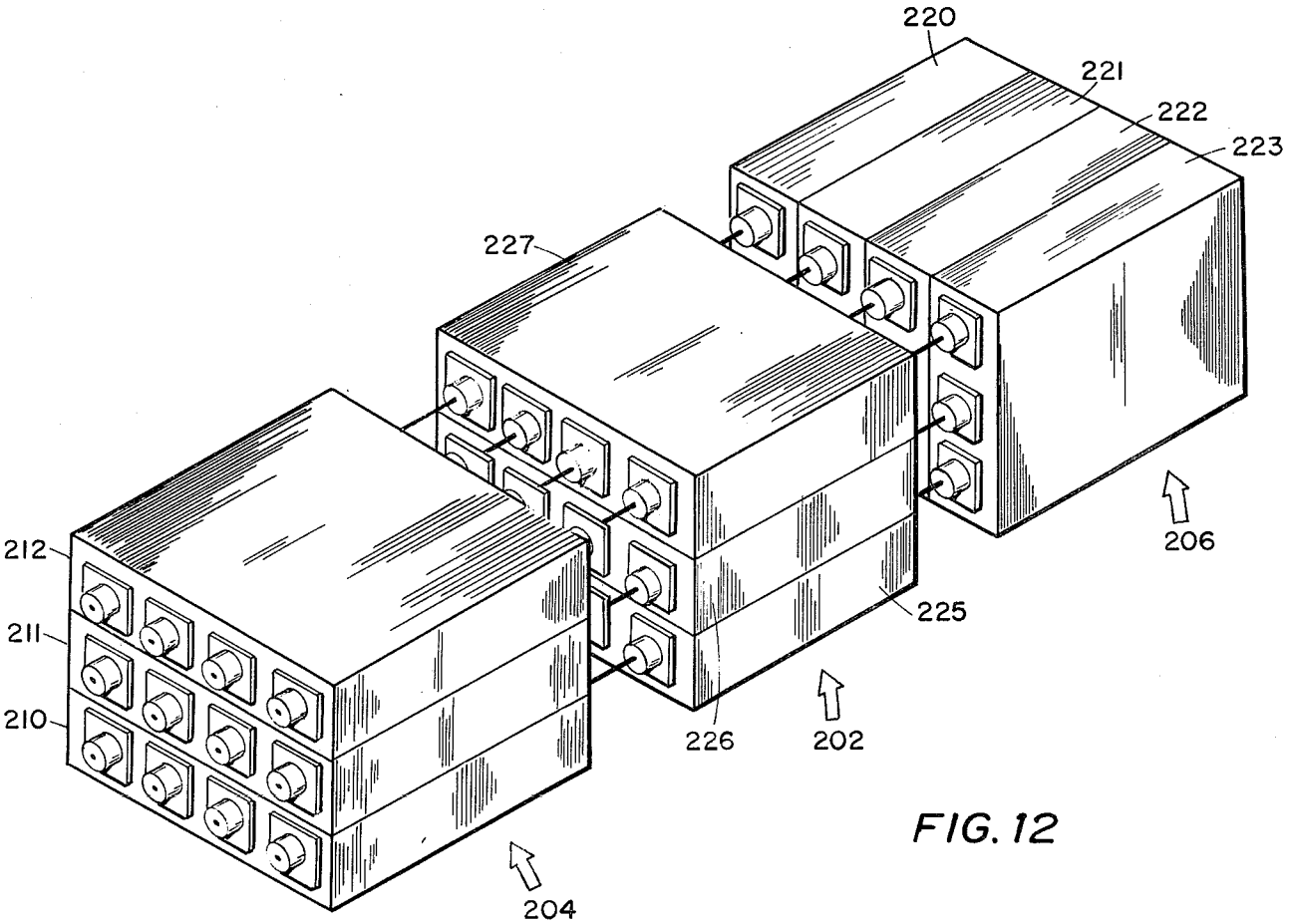
FIG. 12 illustrates a 12×12 Butler matrix made in accordance with the principles of the invention.

In the above embodiment, a 64×64 matrix, it is possible and preferred to use identical smaller matrices, here 8×8 matrices, as standard building blocks at both the input and output stacks. This, of course, is possible because in this case N is an integer squared. It is possible to practice the invention for arrangements where the matrices in one stack differ from the matrices in the other stack. Such a situation is illustrated by FIG. 12 where a 12×12 Butler matrix has a first stack 204 of three 4×4 matrices 210–212 and another stack 206 of four 3×3 matrices 220–213 which is orthogonal to the first stack. A set 202 of phase shifter means 225, 226 and 227 is interposed, suitably equally spaced, between the stacks, so that connecting cables of identical lengths can optimally be used. The specific design of the 4×4 and 3×3 matrices and the appropriate phase shifters should be obvious to one skilled in the prior art.

The specific embodiment of the invention illustrated above is relatively narrow banded. One practicing the invention and having need for a wide banded large Butler matrix can follow the tracking above using relatively wide banded elements. For one example, the phase shifts provided by the line stretcher means of FIG. 10 can be provided by relatively wide band phase shifters such as Schiffman type phase shifters. As another example, wide band microstrip hybrids of the type known to those in the art can be substituted for the hybrid of FIG. 8 in practicing the invention.

One having an understanding of the present invention should be able to use these teaching to produce practical large Butler matrices other than those described herein in addition to those described. Accordingly, the invention is to be limited only by the true spirit and scope of the appended claims.

The invention claimed is:

1. An N×N Butler matrix having phase shifters and interconnecting means intermediate input and output ports comprised of a plurality D of M×M Butler matrices, wherein N is greater than M and an integral multiple thereof, and wherein each of said M×M Butler matrices is contained in a stackable package having M input ports aligned on one end of said package and M output ports on the opposite end of said package, D/2 of said packages being arranged to form an input stack and D/2 of said packages being arranged to form an output stack whose packages are orthogonal to the packages of said input stack.

2. The N×N Butler matrix of claim 1 wherein $M^2$ is equal to N.

3. An N×N Butler matrix having phase shifters and interconnecting means intermediate input and output ports comprised of an input stack formed of a first plurality, D, of essentially identical to each other M×M Butler matrices, wherein N is greater than M, and an output stack formed of a second plurality, E, of essentially identical to each other P×P Butler matrices, wherein N is greater than P, and M×M and P×P matrices being in a planar format, the input ports of each said M×M and P×P matrix being arranged linearly and directed in a first direction and the output ports of each said M×M and P×P matrix being arranged linearly and directed in a second direction, the matrices of the input stack being orthogonal to the matrices of the output stack with the output ports of said input stack aligned with and directed to the input ports of said output stack.

4. The N×N Butler matrix of claim 3 wherein each said M×M and P×P matrix is contained in a relatively flat, rectangular package having two broad opposing faces and four relatively narrow elongated sides, each said side having a longitudinal axis, the input ports of a typical M×M and P×P matrix being arranged along the longitudinal axis of one of said sides, and the output ports thereof being arranged along the longitudinal axis of the opposing side, said ports having longitudinal axes which are perpendicular to the longitudinal axis of the face at which it is arranged.

5. The N×N Butler matrix of claim 4 wherein the longitudinal axis of each input port of a typical M×M and P×P matrix is essentially coextensive with the longitudinal axis of an associated output port of the same M×M or P×P matrix.

6. The N×N Butler matrix of claim 5 wherein the longitudinal axes of the ports of said input stack are arranged essentially coextensive with the longitudinal axes of the ports of said output stack.

7. The N×N Butler matrix of claims 3, 4, 5 or 6 wherein M is equal to P and D is equal to E.

8. The N×N Butler matrix of claims 3, 4, 5 or 6 wherein the product of D and M is equal to the product of E and P.

* * * * *